US006203223B1

(12) United States Patent
Nakayama et al.

(10) Patent No.: US 6,203,223 B1
(45) Date of Patent: Mar. 20, 2001

(54) PRINTER

(75) Inventors: Hiroyuki Nakayama; Kohei Osawa, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/424,972

(22) PCT Filed: Apr. 5, 1999

(86) PCT No.: PCT/JP99/01771

§ 371 Date: Dec. 3, 1999

§ 102(e) Date: Dec. 3, 1999

(87) PCT Pub. No.: WO99/51443

PCT Pub. Date: Oct. 14, 1999

(30) Foreign Application Priority Data

Apr. 6, 1998 (JP) ..... 10-093744
Apr. 6, 1998 (JP) ..... 10-093745
Apr. 6, 1998 (JP) ..... 10-093746

(51) Int. Cl.[7] ..... B41J 11/50
(52) U.S. Cl. ..... 400/605; 400/613; 400/56
(58) Field of Search ..... 400/605, 611, 400/613, 614, 615, 617, 619, 621, 56

(56) References Cited

U.S. PATENT DOCUMENTS 4,322,044 * 3/1982 Bilek ..... 400/621
4,655,625 * 4/1987 Brull et al. ..... 400/605
4,671,686 * 6/1987 Howes et al. ..... 400/611
4,915,525 * 4/1990 Hosoi ..... 400/605
5,887,999 3/1999 Smith et al. ..... 400/621
5,895,158 * 4/1999 Koyabu et al. ..... 400/605
5,899,613 * 5/1999 Koike et al. ..... 400/605
6,022,158 2/2000 Nakayama et al. ..... 400/613
6,042,283 * 3/2000 Koyabu et al. ..... 400/605

FOREIGN PATENT DOCUMENTS 62-9541 1/1987 (JP) .
4-29871 1/1992 (JP) .
5-147283 6/1993 (JP) .
5-147284 6/1993 (JP) .

* cited by examiner

*Primary Examiner*—Eugene Eickholt
(74) *Attorney, Agent, or Firm*—Nixon & Vanderhye P.C.

(57) ABSTRACT

In a printer which can print both a paper roll and cut paper, when cut paper is printed, a gap between the cut paper and a platen can be keep fixed. In an ink-jet printer 1 wherein a printing position for a paper roll 5 is formed in a part of a printing position 11 for cut paper 5, the surface of a platen for a paper roll 16 defining the printing position for the paper roll 5 is backed at least by a dimension G equivalent to the thickness of the paper roll from the surface of a platen for cut paper 13 defining the printing position for the cut paper 4. When cut paper is printed, a gap between a part of cut paper carried with the part overlapped on a paper roll and the platen is equal to a gap between the other part of the cut paper and the platen. Therefore, the deterioration caused by the variation of the gap of the quality of printing on cut paper can be solved.

19 Claims, 14 Drawing Sheets

PRINTER

TECHNICAL FIELD

The present invention relates to a printer which is mounted in a POS terminal and others and which can print cut paper and a paper roll. Further in detail, the present invention relates to a printer wherein a printing position for a paper roll is formed in a part of a printing position for cut paper.

BACKGROUND ART

For an ink-jet printer for printing a paper roll, an ink-jet printer is proposed such that both a paper roll and cut paper can be printed. In Japanese published unexamined patent application No. Hei5-147284, an ink-jet printer of the type is disclosed.

In view of miniaturized requirement, the ink-jet printer of this type has a configuration such that a paper roll and cut paper are carried along a common passage and are printed in a common printing position using a single ink-jet head.

On the other hand, in a POS terminal, a printer for printing a paper roll is generally loaded. In such printers, it is known to a printer which can print both a paper roll and cut paper, a narrower paper roll is used for issuing a receipt or the like, which is narrower in width as compared with the cut paper.

It is conceivable that a part of the cut paper platen surface for defining a printing position for the wider cut paper serves as the surface of a paper roll platen for defining a printing position for the narrower paper roll, and the printing operation is carried out such that when the cut paper is printed by an ink-jet head, the cut paper is overlapped above a paper roll arranged along the surface of the platen for the paper roll.

However, if the configuration is adopted, the following problems will be occurred. That is, a part of the cut paper is carried with it overlapped on the paper roll and the surface of the part is printed by an ink-jet head. Therefore, the surface of the part overlapped with the paper roll of the cut paper is closer to the side of an ink-jet head by at least the thickness of the paper roll, compared with the surface of the other part. As a result, if printing for one line of the cut paper is considered, a gap with the platen is different between the part overlapped with the paper roll and the other part. If the gap with the platen is different, an effect due to dispersion in a position in which an ink droplet jetted from an ink-jet head reaches the surface of the cut paper and a jetted direction becomes large and the quality of printing is deteriorated.

Further, as a paper roll is rolled, paper pulled out of a roll curled and is curved in a direction perpendicular to the surface of the paper roll. Therefore, even if a gap between the print head and the paper roll could be maintained in constant, a gap between the print head and the cut paper further varies between an overlapped part and the other part of the paper roll, because a paper roll carried between a print head and a platen is easily curved and is protruded on the side of the print head.

As described above, when a gap varies, not only the quality of printing is deteriorated but also the printed face of paper comes in contact with a head and the printed face may be contaminated by ink and others.

Further, a transmission mechanism includes mainly a gear train which is used for a mechanism for feeding a paper roll, however, when the carriage of the paper roll is stopped, a platen roller coupled to the last section of the gear train is to be slightly rotated freely forward and backward because of a backlash and others of the gear train for transmitting torque from a driving motor to the platen roller. If holding current is turned off to reduce the generation of heat when a driving motor is stopped, a gear train coupled to the driving motor is easily turned rotatable.

In such a state, a platen roller coupled to the last section of the gear train can be rotated and tensile force acting upon a paper roll carried through the platen roller is released. As a result, the paper roll is loosened because the paper roll is curled and is lifted up from the platen roller.

Hereby, the paper roll in the vicinity of the platen roller is greatly curved on the side of a print head and a gap between the print head and cut paper further varies between a part of the cut paper overlapped with the paper roll and the other part of the cut paper.

In a printer for printing on both a paper roll and cut paper, it is desirable to miniaturize the printer that a common driving motor is used for a driving source for both paper carriage mechanisms. A mechanism for transmitting a rotation to different carriage mechanisms using a common driving motor is disclosed in Japanese published unexamined patent application No. Heil-249472 for example.

The lift of a paper roll is also caused in case that switching means is switched to a cut paper carriage mechanism in a printer such that the rotation of a common driving motor is transmitted by switching between a paper roll carriage mechanism and a cut paper carriage mechanism by the switching means.

As a gear train constituted of the paper roll carriage mechanism is freely rotatable by the switching, a platen roller coupled to the last section is freely rotatable.

The present invention is made in view of the above and the object is to provide a printer which can print on both a paper roll and cut paper and can keep a gap with a platen fixed when cut paper is printed in addition.

DISCLOSURE OF THE INVENTION

To achieve the object, the present invention is provided with a printer, in which a printing position for a roll paper is formed in a part of printing position for cut paper, comprising a platen for a paper roll defining a printing position on a paper roll, a platen for cut paper defining a printing position on cut paper and a print head for printing the paper roll and the cut paper in a common printing position in a printer, characterized in that the surface defining a printing position for a paper roll (a platen surface for the paper roll) is backed at least by the thickness of the paper roll from the surface defining a printing position for cut paper (a platne surface for the cut paper).

As described above, in the printer according to the present invention, the surface of the platen for a paper roll is slightly backed from the surface of the platen for cut paper. Therefore, the surface of the platen for cut paper is approximately flush with the surface of a paper roll arranged along the surface of the platen for a paper roll. That is, the flat surface having no difference in a level of the platen for cut paper is provided.

Therefore, when cut paper is printed, a gap between a part of cut paper carried with it overlapped on a paper roll and the platen is equal to a gap between the other part of the cut paper and the platen. Therefore, the deterioration of the quality of printing on cut paper caused by the variation of a gap between the cut paper and the platen can be solved.

The platen for cut paper is formed in a flat shape a part of which is open and inside the opening, the platen for a paper roll may be also provided. Hereby, cut paper is supported by the platen for cut paper in a wide area including its right and left ends. In this case, to facilitate the loading of a paper roll, when the paper roll is loaded, the platen for a paper roll may be also backed from the printing position of a paper roll.

To precisely define positional relationship between the surface of the platen for cut paper and the surface of the platen for a paper roll, the following configuration can be adopted.

That is, the platen for cut paper is positioned, a frame for supporting the platen for cut paper is provided and a positioning part is provided to the platen for a paper roll. Further, a contact part with which the positioning part of the platen for a paper roll comes in contact when the platen for a paper roll approaches the side of the opening is provided to the frame. It is desirable that positional relationship between the surface of the platen for a paper roll and the surface of the platen for cut paper is determined by touching the positioning part to the contact part of the frame.

Further in the printer according to the present invention, tensile force in a transport direction is applied to the printed face of a paper roll carried to a printing position by the tensile force applying means. As the paper roll carried with it curved having a curl of rolling is straightened by the tensile force, the printed face is forcedly turned flat.

As a result, even in case a paper roll is carried, it is never lifted and a gap between cut paper carried afterward and the print head becomes equal between a part overlapped with the paper roll and the other part.

The tensile force applying means can include a pressing member which can press a paper guide attached to the platen for a paper roll for guiding a paper roll to a printing position by predetermined elastic pressure is provided.

The paper roll feeding roller pulls a part of printed face of a paper roll on the downstream side in a transport direction, in the transport direction. In the meantime, a part of the paper roll on the upstream side of the part of the printed face in the transport direction is pressed upon the paper guide by the pressing member.

As a result, tensile force acts upon the part of the printed face of the paper roll in the transport direction, and the curved state of the paper roll is corrected and is substantially turned flat.

For the pressing member, a pressing roller which can be rotated can be used and in this case, it is desirable that a paper roll is pressed against the paper guide by the peripheral surface of the pressing roller.

To enable regulating tensile force applied to a paper roll more easily and applying stable tensile force to the paper roll, it is desirable that a brake roller serving as the tensile force applying means is arranged on a position at which the paper guide is pressed by the pressing member. As for the brake roller, predetermined elastic braking force acts upon rotation in a direction in which a paper roll is carried. In this case, the brake roller can be provided with the a roller body supported so that the roller can be rotated and a pressure spring applying predetermined spring to the side of the body.

In addition to the configuration, the printer includes a driving motor for rotating the paper roll feeding roller and a gear train for feeding a paper roll for transmitting the rotation of the driving motor to the paper roll feeding roller, rotation restriction means for applying braking force to restrict free rotation may be also further provided to a gear included in the gear train for feeding a paper roll.

As described above, braking force is applied to at least one gear included the gear train by the rotation restriction means and free rotation is restricted. Therefore, as braking force acts upon the gear even if the driving motor is stopped, the gear is not substantially rotated. As a result, the paper roll feeding roller coupled to the final section of the gear train including the gear is also not rotated. Therefore, a paper roll is kept a state in which predetermined tensile force acts as in its carried state.

The rotation restriction means can be particularly applied to a type that a paper roll and cut paper are carried by a common driving motor. That is, the rotation restriction means can be applied to a printer provided with a cut paper feeding roller, a gear train for feeding cut paper for transmitting the rotation of the driving motor to the cut paper feeding roller and switching means for switching to either of the gear train for feeding a paper roll or the gear train for feeding cut paper to transmit the rotation of the driving motor in addition to the configuration.

In the printer provided with the configuration, when the transmission of the rotation of the driving motor is switched to the side of the gear train for feeding cut paper, the rotation of the paper roll feeding roller coupled to the gear train is also restricted, because braking force acts upon a gear included in the gear train for feeding a paper roll.

Therefore, as tensile force acting upon the paper roll is never released, the paper roll is never lifted on the side of the print head.

As described above, it is desirable that a printer with the paper roll feeding roller being moved is provided that the gear train for feeding a paper roll includes a gear rotated together with the paper roll feeding roller and braking force is applied by the rotation restriction means to a gear directly engaged with the gear rotated together with the paper roll feeding roller.

That is, as the rotation restriction means is arranged not to rotate the paper roll feeding roller, it is desirable that braking force is applied to as a close gear to the paper roll feeding roller as possible.

However, in configuration that the paper roll feeding roller is also moved when the platen for a paper roll is moved, as a gear rotated together with the paper roll feeding roller is moved together with the paper roll feeding roller, it may be difficult to apply stable braking force to the gear. Then, according to the present invention, if braking force is applied to a gear which is engaged with the gear rotated together with the paper feeding roller and is always attached to a fixed position on the side of the body of the printer, stable braking force can be applied and in addition, the rotation of the paper roll feeding roller can be effectively restricted.

Next, in the printer according to the present invention, in place of the rotation restriction means, a rotation preventing mechanism for preventing the rotation of a gear can be also provided. In this case, while the driving motor is stopped, the rotation of the gear is to be prevented by the gear rotation preventing means.

In a printer including a cut paper feeding roller, a gear train for feeding cut paper for transmitting the rotation of the driving motor to the cut paper feeding roller and switching means for switching to either of a gear train for feeding a paper roll or the gear train for feeding cut paper to transmit the rotation of the driving motor are provided, the gear rotation preventing means has only to prevent the rotation of the gear while the rotation of the driving motor is transmitted to the gear train for feeding cut paper.

BEST EMBODIMENTS OF THE INVENTION

Figure 1:
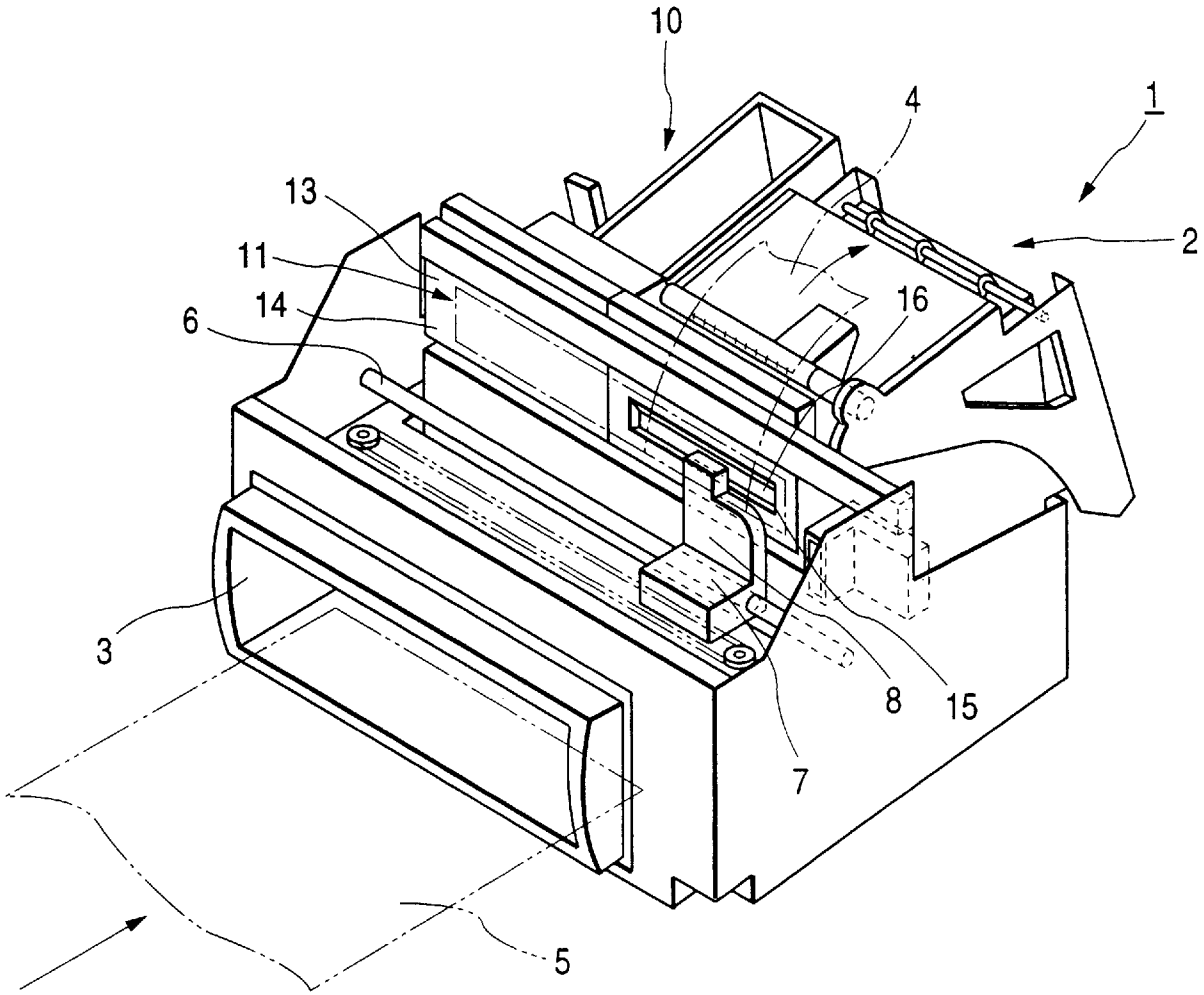
FIG. 1 is a perspective view showing an ink-jet printer to which the present invention is applied.

Referring to the drawings, embodiments of an ink-jet printer to which the present invention is applied will be described below.

Whole Configuration of Ink-Jet Printer

Figure 2:
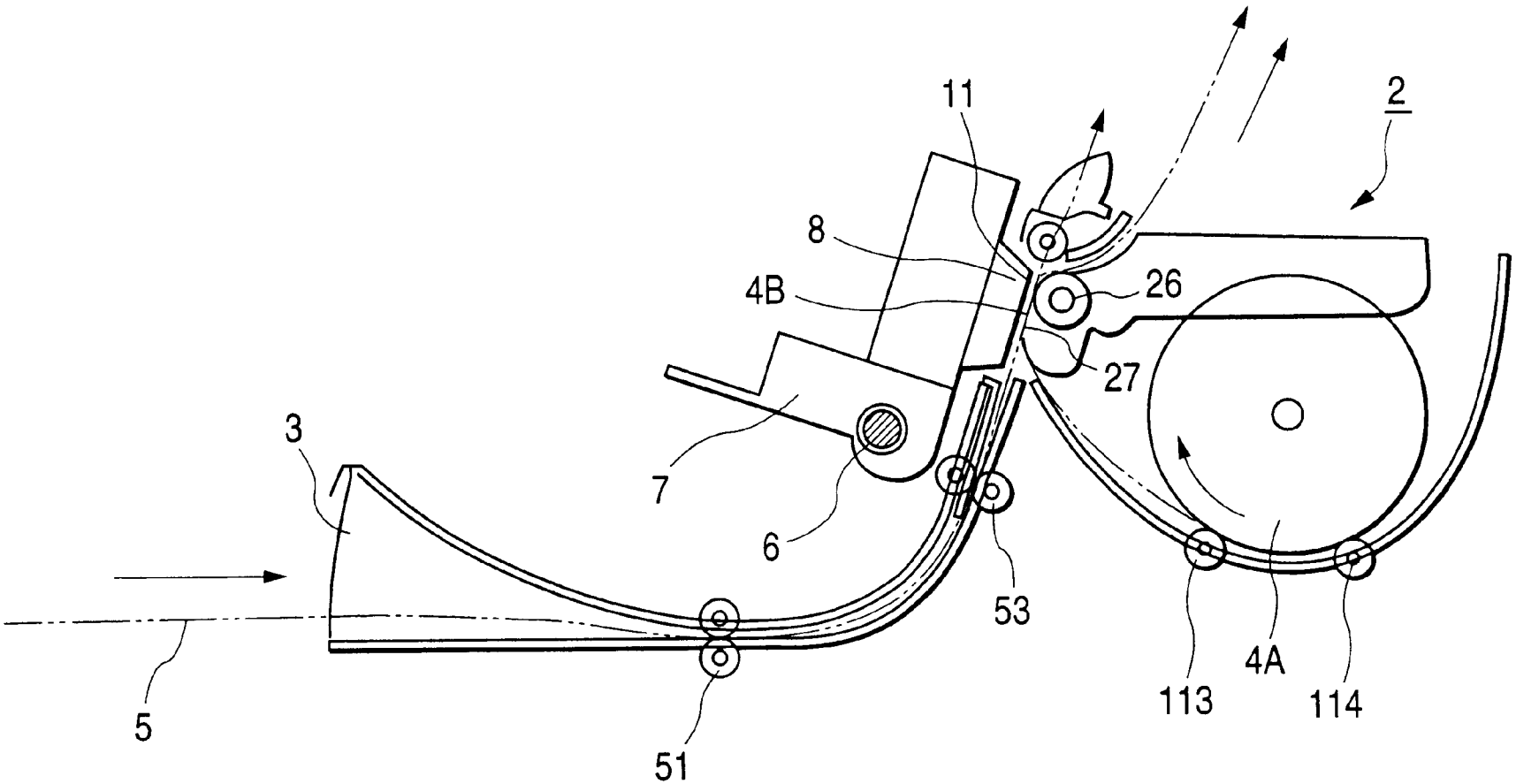
FIG. 2 is an explanatory drawing showing a paper transport path in the ink-jet printer shown in FIG. 1.

FIG. 1 is a perspective view showing an ink-jet printer to which the present invention is applied and FIG. 2 is an explanatory drawing showing its paper transport path. As shown in these drawings, the ink-jet printer 1 is provided with a paper roll loading mechanism 2 and a port 3 for inserting cut paper in A4 size or in another size, and a transport path such that a paper roll 4 supplied from the paper roll loading mechanism 2 and cut paper 5 inserted from the cut paper inserting port 3 are respectively carried through a common printing position 11 (an area surrounded by an alternate long and short dash line in FIG. 1). A guide shaft 6 is arranged in parallel with the common printing position 11 and a carriage 7 on which an ink-jet head 8 is mounted is provided along the guide shaft 6 so that the carriage can be reciprocated. Therefore, desired printing is performed on the surface of the paper roll 4 or the cut paper 5 which passes the common printing position 11 by the ink-jet head 8.

Ink is supplied from an ink supply part 10 mounted in a position adjacent to the paper roll loading mechanism 2 to the ink-jet head 8 through an ink tube not shown.

Figure 3:
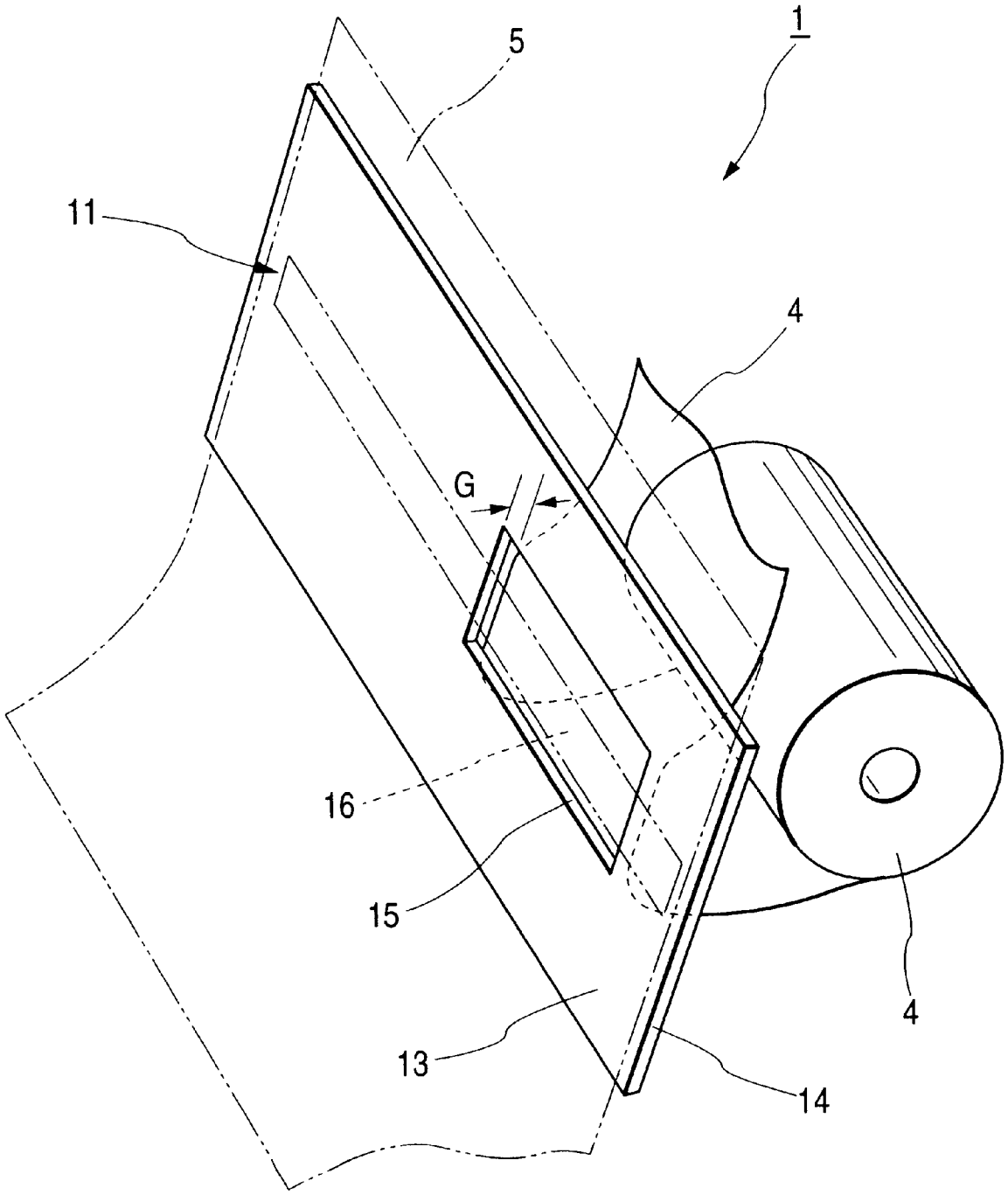
FIG. 3 is an explanatory drawing showing positional relationship between the surface of a platen for cut paper and the surface of a platen for a paper roll in the ink-jet printer shown in FIG. 1.

Positional Relationship Between the Surface of a Platen for Cut Paper and the Surface of a Platen for a Paper Roll FIG. 3 shows the common printing position 11. As shown in FIG. 3, the common printing position 11 is defined by the surface of the platen for cut paper 13. The surface of the platen for cut paper 13 is formed on the surface of a platen member for cut paper 14 formed by a rectangular plate member. An elongated rectangular opening 15 is open in a part on one side in a direction of the width of the surface of the platen for cut paper 13. From the rectangular opening 15, the surface of the platen for a paper roll 16 can be seen. The surface of the platen for a paper roll 16 is defined by the peripheral surface of a platen roller 26 (a platen member for a paper roll) described later in detail.

In this embodiment, the surface of the platen for a paper roll 16 is backed from the surface of a nozzle not shown of the ink-jet head 8 at least by distance G corresponds to the thickness of the paper roll 4 differently from the surface of the platen for cut paper 13.

When the cut paper 5 is printed, a part of the cut paper 5 is carried over the printing position 11 under the condition that the part overlapped on the paper roll 4 is always laid on the surface of the platen roller 26. However, as described above, as the surface of the platen for a paper roll 16 corresponding to the peripheral surface of the platen roller 26 is slightly backed, the part of the cut paper 5 overlapped on the paper roll 4 is never protruded on the side of the ink-jet head 8, compared with the other part of cut paper. In other words, in the printing position 11, a gap between the cut paper 5 and the platen is kept fixed throughout the width of printing.

Therefore, according to the ink-jet printer equivalent to this printer, as a gap between cut paper and the platen can be kept fixed when the cut paper 5 is printed, the deterioration of the quality of printing caused by the variation of the gap can be avoided.

The dimension of the gap G should be set to an optimum value in an individual printer, however, it is desirable that the gap is at least equal to or larger than the thickness of a paper roll.

Figure 4:
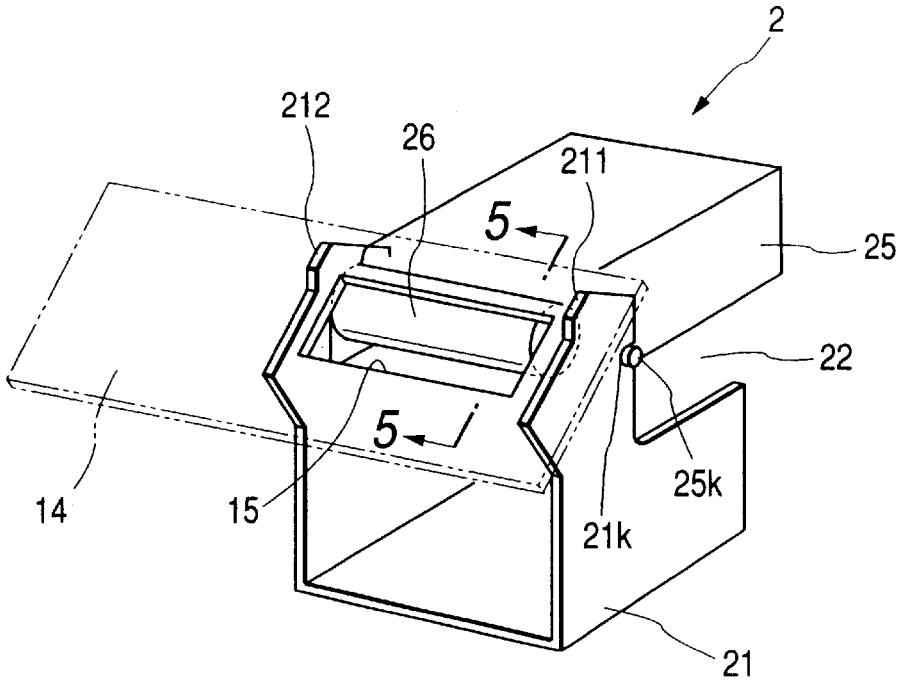
FIG. 4 is an explanatory drawing showing a positioning mechanism for a platen member for cut paper in the ink-jet printer shown in FIG. 1.
Figure 5:
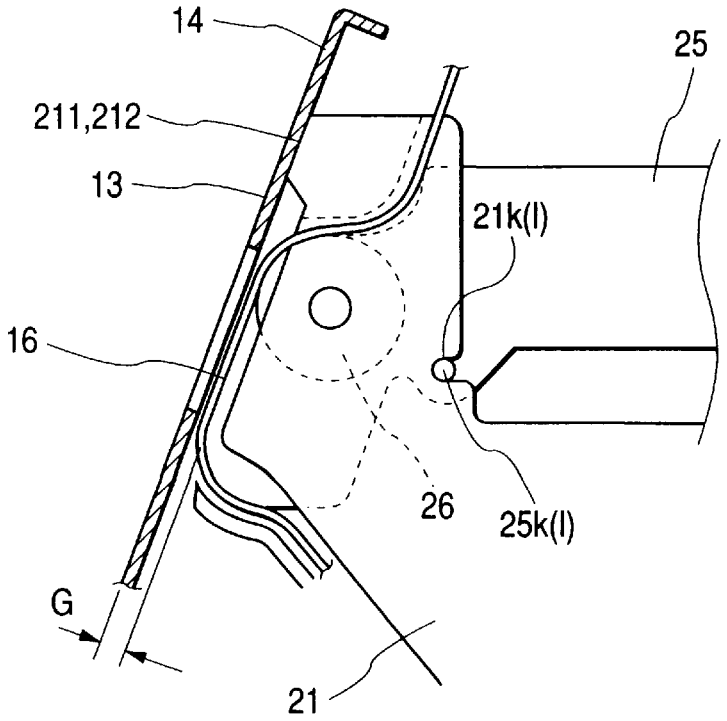
FIG. 5 is an explanatory drawing showing a positioning mechanism for a platen member for cut paper in the ink-jet printer shown in FIG. 1.

Next, in this embodiment, structure for precisely defining positional relationship between the surface of the platen for cut paper 13 and the surface of the platen for a paper roll 16 is provided. FIGS. 4 and 5 shows only the structure for positioning. As shown in these drawings, a pair of right and left positioning pins 25*k* and 25*l* and grooves 21*k* and 21*l* for defining the position of the platen roller 26 are provided to a part 22 for loading the paper roll 4 in the paper roll loading mechanism 2 though the positioning pins and the grooves will be detailed described later. Owing to the positioning mechanism, the platen roller 26 is arranged in a predetermined position for the ink-jet head 8.

A pair of right and left front end faces for positioning 211 and 212 (parts shown by diagonal lines in FIG. 4) are formed on a frame for attachment 21 which is fixed to the body of the printer and on which the grooves for positioning 21*k* and 21*l* are formed. These front end faces 211 and 212 are formed by forward protruding each upper end part of each front side of right and left side walls of the frame for attachment 21. The pair of front end faces 211 and 212 are located on both sides of the rectangular opening 15 formed on the platen member for cut paper 14. The platen member for cut paper 14 is attached to the pair of front end faces 211 and 212 so that the rear surface of the platen member closely comes in contact with the front end faces.

As described above, in this embodiment, positional relationship between the platen roller 26 and the platen member for cut paper 14 is defined by the grooves for positioning 21*k* and 21*l* and the front end faces 211 and 212 respectively formed on the frame for attachment 21 fixed to the body of the printer. In other words, positional relationship between the surface of the platen for a paper roll 16 and the surface of the platen for cut paper 13 is defined by the frame for attachment 21 which is a single member on the fixed side. Therefore, the relative positions of these can be precisely defined and as a result, a gap between cut paper and the platen in a direction of the printing width of cut paper carried over the printing position 11 can be kept precisely fixed.

Configuration of Tensile Force Applying Means

As shown in FIG. 2, the paper roll 4 is pulled out of a roll 4A rolled loaded into the paper roll loading mechanism 2 and is carried through the printing position 11. Therefore, the paper roll has a curl of rolling and a part of the paper roll which passes the printing position 11 tends to be curved in a convex state on the side of the ink-jet head 8. In this embodiment, to rectify the curve of a part which passes the printing position 11 of such a paper roll, that is, a printing face and form a flat printing face, tensile force applying means is provided.

Figure 6:
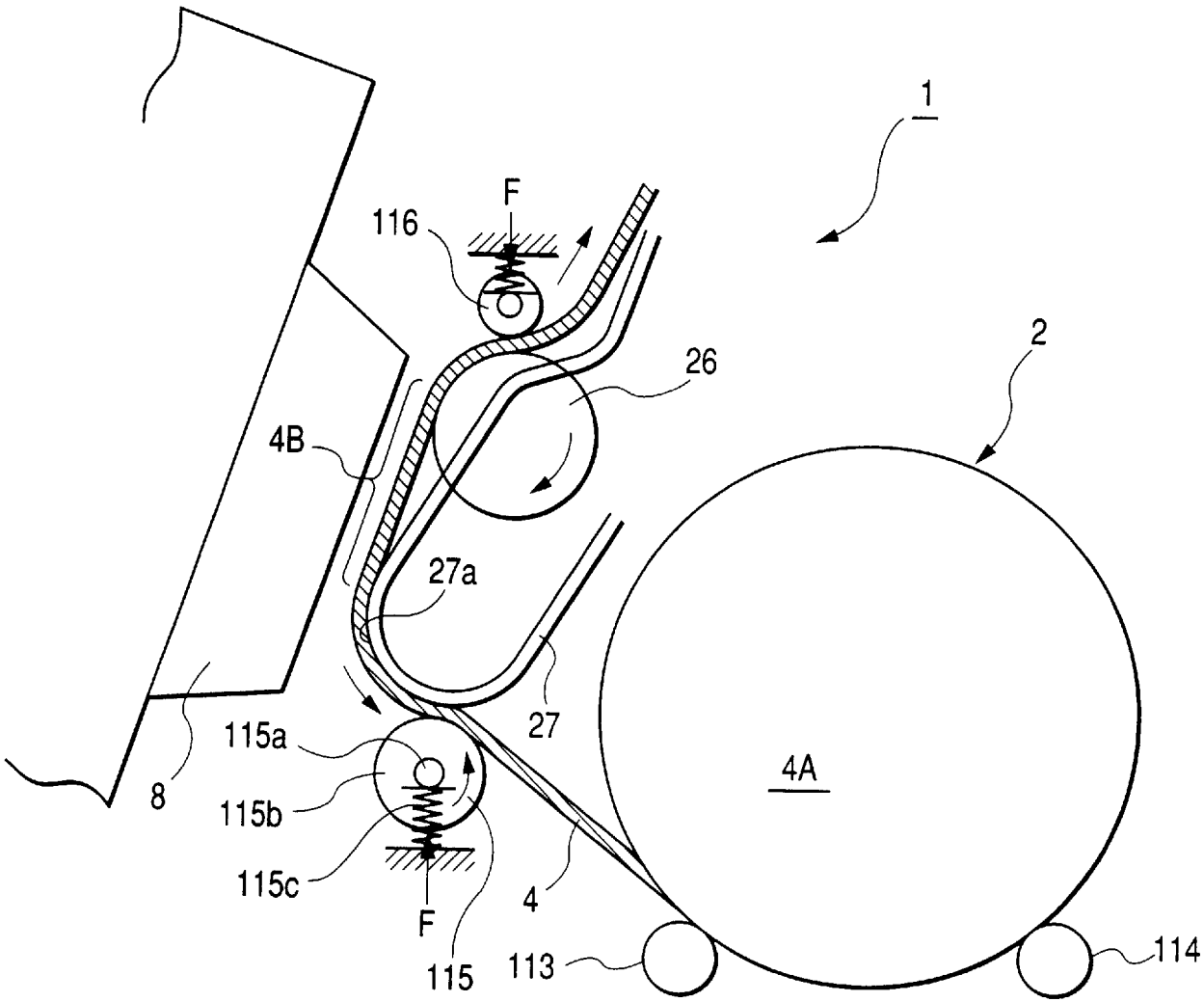
FIG. 6 shows the configuration of tensile force applying means for applying tensile force to a paper roll in the ink-jet printer shown in FIG. 1.

FIG. 6 shows an enlarged main component with the printing position 11 in the center of a paper roll transport path of the ink-jet printer 1. Referring to FIGS. 6 and 2, the tensile force applying means in this embodiment will be described below.

As shown in these drawings, the roll 4A is supported by a pair of front and back rotatable supporting rollers 113 and 114 arranged on the bottom of a paper roll loading part described later. The paper roll 4 pulled out of the roll 4A passes between a paper guide 27 and a pressing roller 115 as a pressing member and is guided to the platen roller 26 located along the convex curved surface 27*a* of the paper guide 27. The paper roll 4 next passes between the platen roller 26 and a pressure roller 116 pressed upon the platen roller and is ejected outside.

A part of the paper roll 4 laid between the paper guide 27 and the platen roller 26 is located in the position 11 printed by the ink-jet head 8. That is, this part of the paper roll 4 is equivalent to a part of the printed face 4B printed by the ink-jet head 8.

Though its detailed structure will be described later, the platen roller 26 and the paper guide 27 are attached to the end of a slide frame 25 shown in FIG. 11 which is a component of the cover of the paper roll loading mechanism 2, and are moved together with the slide frame 25. FIGS. 2 and 6 show the position of the platen roller 26 and the paper guide 27 in a state in which the slide frame 25 is closed and the position is called the operated position of the platen roller 26 if necessary in this specification. Also, the position of the platen roller 26 backed from the operated position because the slide frame 25 is opened is called an idle position if necessary.

Figure 9:
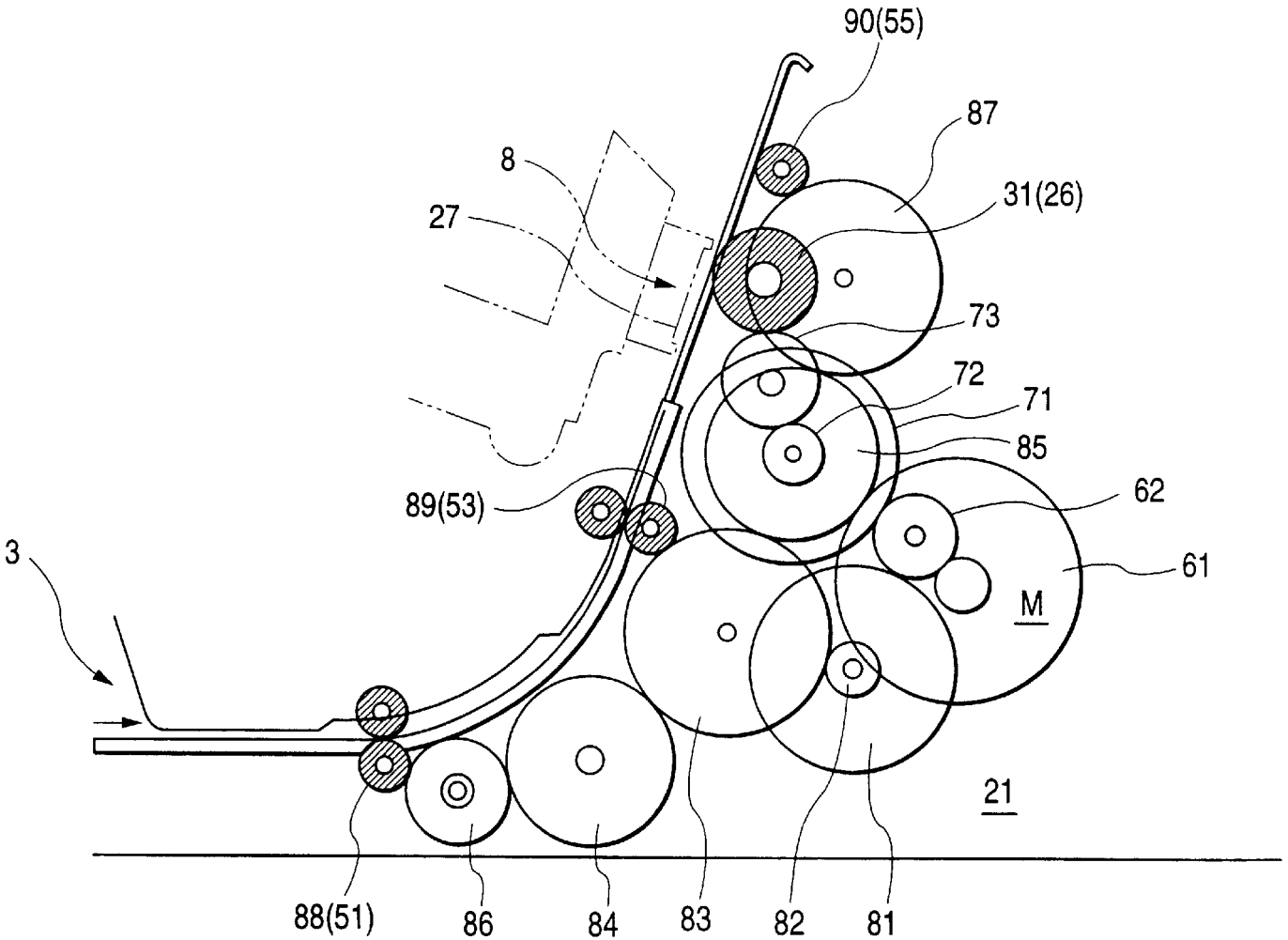
FIG. 9 is a schematic drawing showing a driving force transmission mechanism in the ink-jet printer shown in FIG. 1.

The platen roller 26 is provided so that when it is set on its operated position, it is coupled to a driving force transmission mechanism shown in FIG. 9 and is rotated. The pressure roller 116 is pressed upon the peripheral surface of the platen roller 26 by fixed spring as described above. Therefore, the paper roll 4 put between these rollers 26 and 16 is carried as the platen roller 26 is rotated.

The tensile force applying means in this embodiment is defined by the pressing roller 115. The pressing roller 115 is provided with a rotating central shaft 115*a*, the body 115*b* of the roller supported by the rotating central shaft 115*a* so that the body can be rotated and a spring member 115*c* pressing both ends of the rotating central shaft 115*a* on the side of the paper guide 27.

The pressing roller 115 is pressed upon the surface 27*a* of the paper guide 27 in a position on the upstream side in a transport direction from the part 4B of the printed face of the paper roll 4 by fixed spring. Therefore, tensile force is applied to the paper roll 4 which passes between these and is pulled by the torque of the platen roller 26. That is, as the paper roll 4 is pressed upon the surface 27*a* of the paper guide 27 by fixed spring, tensile force acts upon the printed face 4B of the paper roll 4 laid between the pressing roller 115 and the platen roller 26 along a transport direction by sliding frictional resistance generated by the pressure.

As a result, even if the paper roll 4 has a curl of rolling, the curve of the printed face 4B of the paper roll 4 located in the position 11 printed by the ink-jet head 8 is straightened by the tensile force and the printed face is substantially turned flat. Therefore, a gap between the ink-jet head 8 and the printed face 4B is kept fixed, and the deterioration of the quality of printing, the stain of the surface of the paper roll, the jam of the paper roll in the printing position and others respectively caused by the variation of the gap can be avoided. When the paper roll is carried, it is never lifted and a gap between cut paper carried afterward and the print head does not vary between a part overlapped on the paper roll and the other part.

Another Configuration of Tensile Force Applying Means

Figure 7:
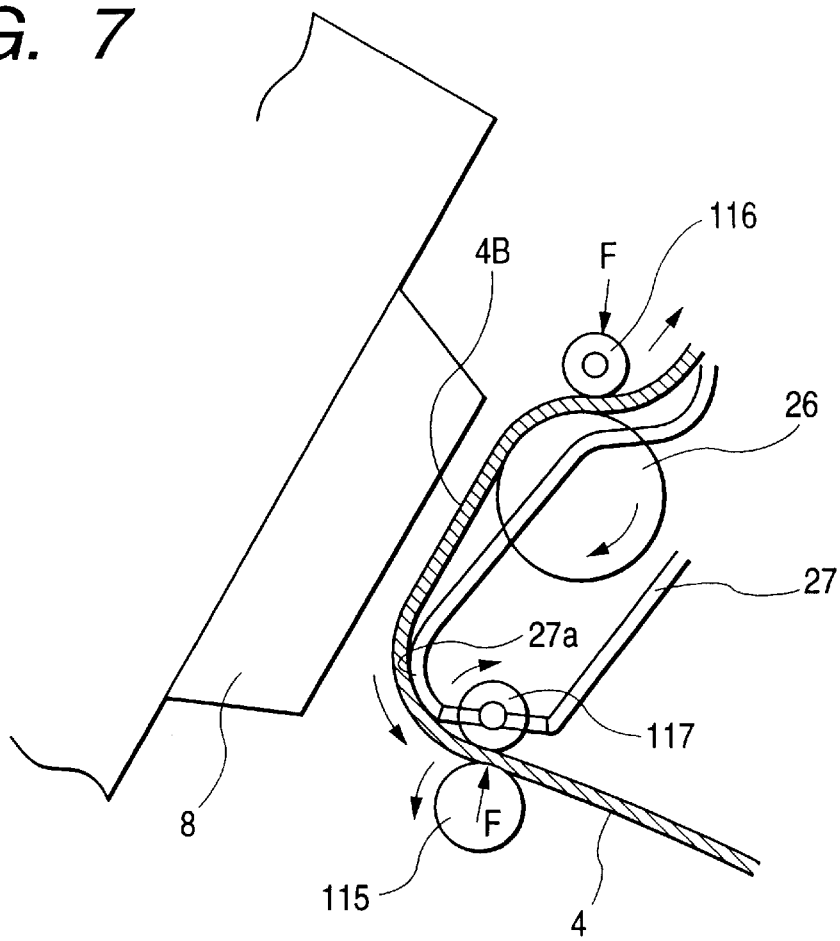
FIG. 7 shows a transformed example of the tensile force applying means shown in FIG. 6.
Figure 8:
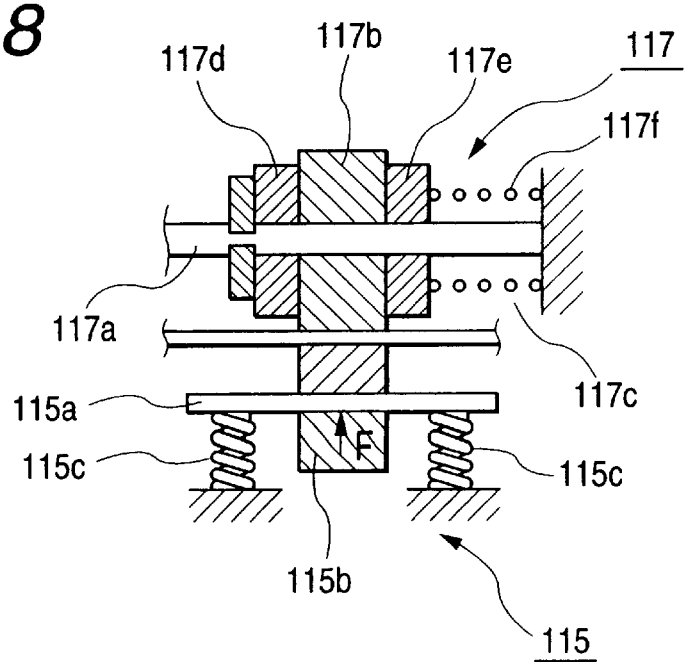
FIG. 8 shows a case in which the tensile force applying means shown in FIG. 7 is seen from a perpendicular direction.

Next, FIGS. 7 and 8 show a transformed example of the tensile force applying means provided as described above. Tensile force applying means shown in these drawings can more easily regulate tensile force applied to the paper roll and in addition, can apply stable tensile force to the paper roll. To achieve the object, for the tensile force applying means in this example, a brake roller 117 is arranged on the surface pressed by the pressing roller 115 of the paper guide 27.

The brake roller 117 applies predetermined elastic braking force to rotation in a paper roll carriage direction and when the paper guide 27 is set in its operated position, the paper roll 4 is put between the brake roller 117 and the pressing roller 115.

As clear from FIG. 8, the brake roller 117 is provided with a rotating central shaft 117*a*, the body 117*b* of the roller supported by the rotating central shaft 117*a* so that the body can be rotated and a pressing mechanism 117*c* for pressing the side of the body 117*b* of the roller in a direction of its rotational axis by fixed spring.

The pressing mechanism 117*c* includes a receiving plate 117*d* touched to one side of the body 117*b* of the roller, a pressure plate 117*e* touched to the other side and a coil spring 117*f* pressing the pressure plate 117*e* upon the side of the body 117*b* of the roller.

The pressing roller 115 touched to the brake roller 117 includes a rotating central shaft 115*a*, the body 115*b* of the roller supported by the rotating central shaft 115*a* so that the body can be rotated and a spring member 115*c* pressing the rotating central shaft 115*a* by fixed spring toward the brake roller 117.

In the tensile force applying means provided as described above, the paper roll 4 is put between a pair of rollers 115 and 117, elastic braking force is applied to the rotation of one roller 117 and tensile force is applied to the paper roll 4 using the sliding frictional resistance generated as a result of the paper roll 4. Therefore, the regulation of tensile force to be applied is facilitated, compared with a case that tensile force is applied to the paper roll 4 by the sliding frictional resistance generated by pressing and fixing the pressing roller 115 upon the surface of the paper guide 27 of the paper roll 4 and stable tensile force can be generated.

Driving Force Transmission Mechanism and Rotation Restriction Means

Figure 10A:
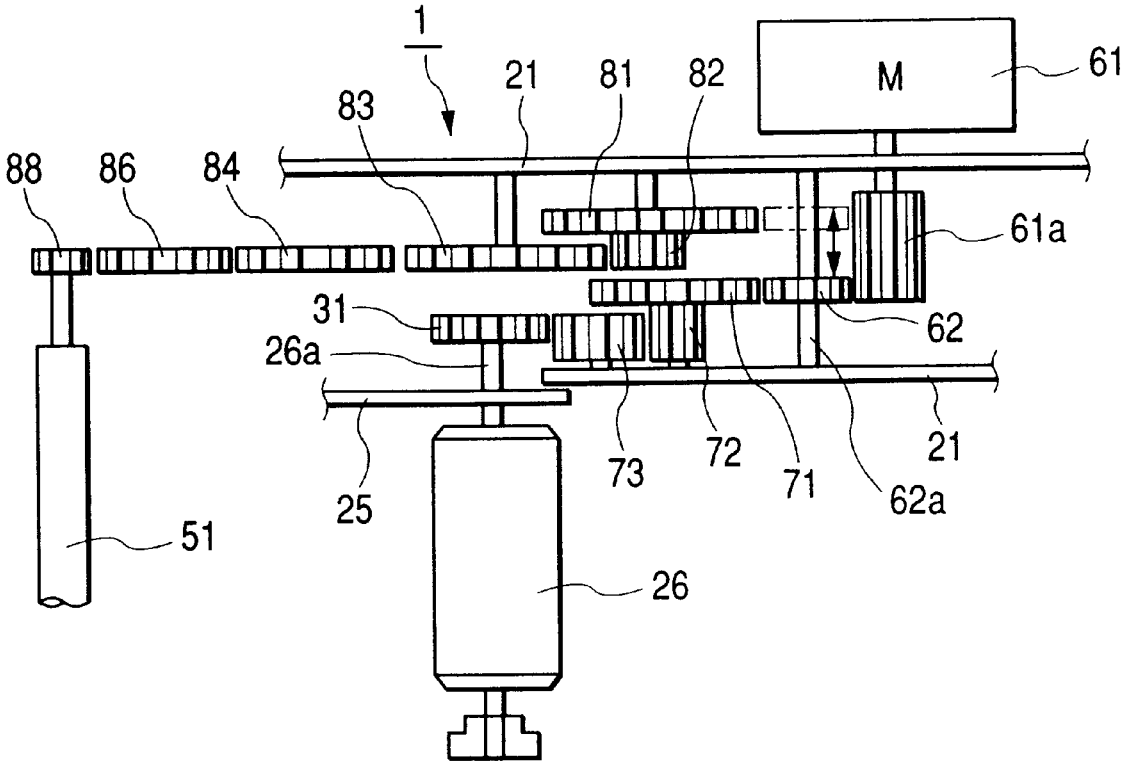
FIG. 10(*a*) is a schematic drawing showing the driving force transmission mechanism in the ink-jet printer shown in FIG. 1 and FIG. 10(*b*) is a schematic drawing showing the configuration of rotation restriction means.
Figure 10B:
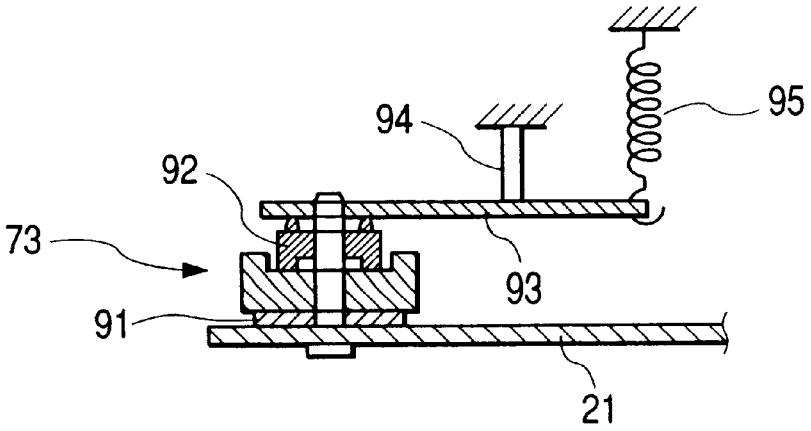

Next, FIGS. 9 and 10 show the schematic configuration of a driving force transmission mechanism built in the ink-jet printer 1 in this embodiment. The driving force transmission mechanism is provided so that it transmits rotation from a single driving motor to a gear train for feeding a paper roll and a gear train for feeding cut paper through switching means and rotates the platen roller 26 which is a paper roll feeding roller, paper feeding rollers for feeding cut paper 51, 53 and 55. In FIG. 9, to facilitate understanding, the position of the platen roller 26 and the paper feeding rollers 51, 53 and 55 is shown by diagonal lines.

In the ink-jet printer 1 equivalent to this embodiment, rotation restriction means for restricting the rotation of the gear train for feeding a paper roll is provided so that tensile force applied to the paper roll 4 by the tensile force applying means is not released when the platen roller 26 is stopped. FIGS. 10 show the schematic configuration of the rotation restriction means.

First, the driving force transmission mechanism will be described. The driving force transmission mechanism is provided with a single driving motor 61, a gear train for feeding a paper roll engaged with a driving gear 61*a* for transmitting the rotation of the motor to the platen roller 26, a gear train for feeding cut paper for transmitting the rotation of the motor to the cut paper feeding rollers 51, 53 and 55 and a gear for switching (switching means) 62 for switching to either gear train for transmitting the rotation of the motor. The gear for switching 62 is always engaged with the driving gear 61*a* attached to the output shaft of the motor.

The gear train for feeding a paper roll includes a first gear 71 which can be engaged with the gear for switching 62, a second gear 72 coaxially coupled to the gear 71, a third gear 73 engaged with the second gear 72 and a platen roller driving gear 31 engaged with the third gear 73. The platen roller driving gear 31 is coaxially coupled to the end of the rotating shaft 26*a* of the platen roller 26 and is fixed.

In this embodiment, as described later, the platen roller 26 is attached to the end of the slide frame 25 which is a component of the cover of the paper roll loading mechanism 2 and when the platen roller 26 is positioned in its operated position, the driving gear 31 attached to the rotating shaft 26*a* of the platen roller 26 meshes with the third gear 73.

In the meantime, the gear train for feeding cut paper is provided with a first gear 81 which can be meshed with the gear for switching 62, a second gear 82 coaxially coupled to the first gear 81, a third gear 83 meshed with the second gear 82, fourth and fifth gears 84 and 85 respectively meshed with the third gear, a sixth gear 86 meshed with the fourth gear 84 and a seventh gear 87 meshed with the fifth gear. Further, a paper feeding roller driving gear 88 engaged with the sixth gear 86, a paper feeding roller driving gear 89 engaged with the third gear 83 and a paper feeding roller driving gear 90 engaged with the seventh gear 87 are provided. The paper feeding roller driving gear 88 is coaxially coupled to the paper feeding roller 51, the paper feeding roller driving gear 89 is coaxially coupled to the paper feeding roller 53 and the paper feeding roller driving gear 90 is coaxially coupled to the paper feeding roller 55.

The gear for switching 62 can be moved along its rotating central shaft 62*a* between a position shown by a full line (a paper roll driving position) and a position shown by an imaginary line (a cut paper driving position) respectively shown in FIG. 10 and is moved by a driving mechanism not shown including an electromagnetic solenoid and others.

As clear from FIGS. 9 and 10, when the gear for switching 62 is located in the position shown by the full line (the paper roll driving position), the rotation of the motor is transmitted to the driving gear 31 in the final section through the first to third gears 71 to 73 and the platen roller 26 is rotated. As a result, the paper roll 4 is carried.

When the gear for switching 62 is located in the position shown by the phantom line (the cut paper driving position), the rotation of the motor is respectively transmitted to the paper feeding roller driving gears 88, 89 and 90 through the first to seventh gears 81 to 87 and each paper feeding rollers 51, 53 and 55 are rotated. As a result, the cut paper 5 is carried.

Rotation restriction means is attached to the third gear 73 which corresponds to a gear constituted of the gear train for feeding a paper roll as shown in FIG. 10(*b*) and braking force for restricting rotation is always applied. The rotation restriction means in this embodiment is provided with a spacer 91 arranged between the third gear 73 and a printer body frame 12, a brake plate 92 arranged on the other side of the third gear 73, a pressing lever 93 which can press the brake plate 92, a lever support member 94 supporting the lever 93 in the middle position and a coil spring 95 coupled to the other end of the lever 93.

The coil spring 95 is coupled to the lever 93 in a extended state. Therefore, the end of the lever 93 presses the brake plate 92 upon the side of the third gear 73 with the support member 94 in the middle of the lever as a support. Braking force that restricts the rotation of the gear always acts upon the third gear 73 by the lateral pressure of the brake plate 92.

As described above, according to the printer 1 in this embodiment, braking force that restricts the rotation always acts upon the third gear 73 which is a component gear of the gear train for feeding a paper roll. The braking force is not great force such as the rotation of the platen roller 26 by the rotation of the driving motor 61 is prevented, however, in a state in which torque is not transmitted through the gear train for feeding a paper roll, the braking force is set to force enough to prevent the rotation of the gear train.

Therefore, the rotation of the gear train for feeding a paper roll is also prevented when the gear for switching 62 is switched to the cut paper driving position so that the platen roller 26 coupled to the final section is never rotated. Therefore, when the paper roll 4 is loosened and is curved on the side of the ink-jet head 8, the surface of the paper roll is free from the stain caused by the ink or the like adhering to the surface of the nozzle. That is, even if printing on the paper roll 4 is stopped and the gear for switching 62 is switched to print the cut paper 5, a state in which tensile force applied by the tensile force applying means acts upon the paper roll 4 can be kept.

As described above, a reason why braking force is applied is that the rotation of the platen roller 26 is prevented. For it, braking force has only to be directly applied to the driving gear 31 coupled to the platen roller 26. However, in this embodiment, as the platen roller 26 and the driving gear 31 are attached to the slide frame 25 and are moved together with the slide frame, it is difficult to attach a mechanism for applying braking force. Then, in this embodiment, of the gears attached to the frame 21, the rotation of the platen roller 26 is effectively prevented by applying braking force to the gear 73 closest to the platen roller 26.

Another Example of Rotation Restriction Means

In place of the rotation restriction means in this embodiment, rotation preventing means can be also attached. For the rotation preventing means, for example, the configuration can be adapted, that is, a lock pin or the like are pressed upon the third gear 73 to avoid the rotation of the third gear 73 in cooperate with the switching operation of the switching gear 62. In this case, it is applicable for the structure such that a lock pin or the like are pressed upon the third gear 73 to avoid the rotation of the third gear in cooperate with the stop of the driving motor 61.

Paper Roll Loading Mechanism

Next, the structure of the paper roll loading mechanism 2 in this embodiment will be described in detail.

Figure 11:
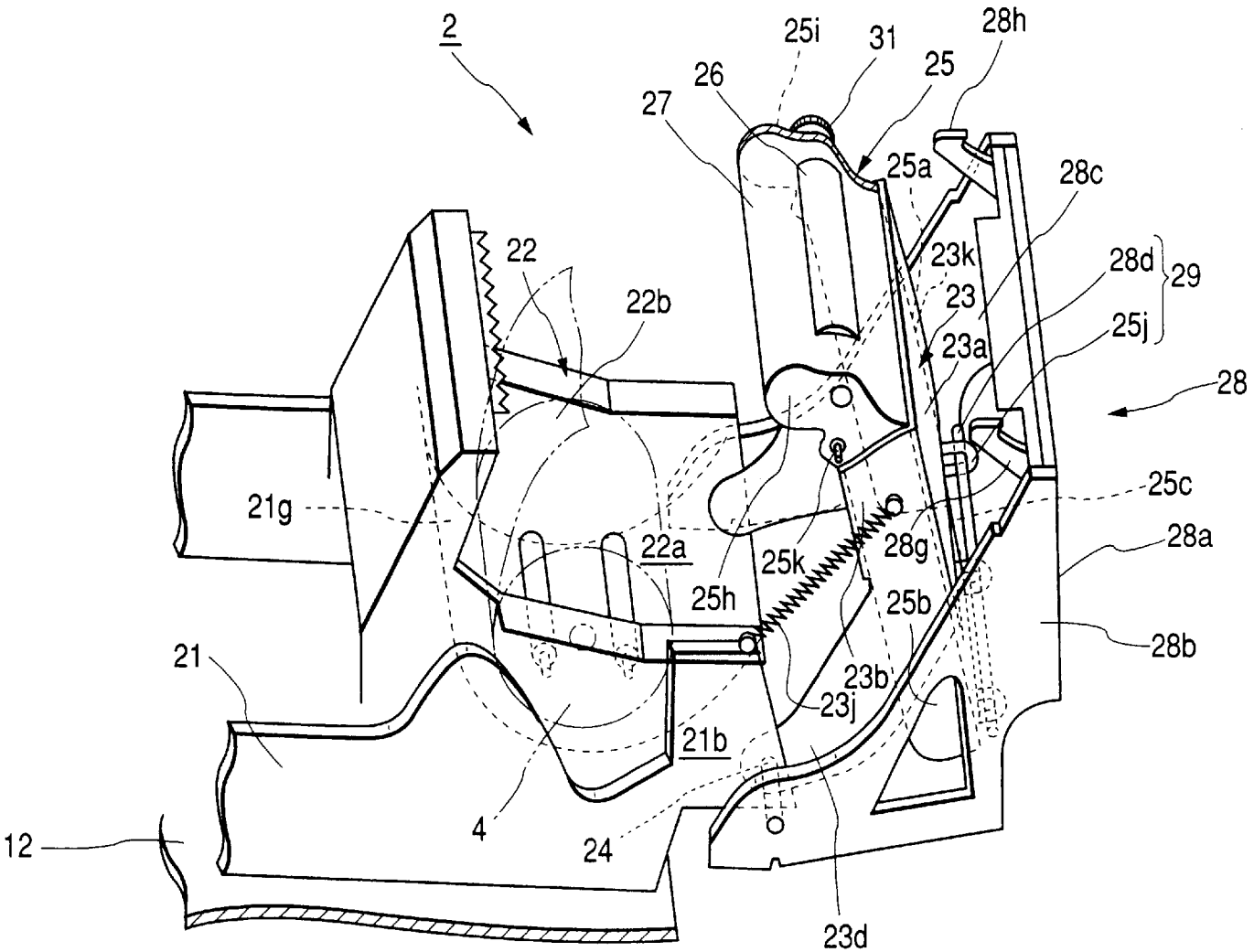
FIG. 11 is a partial perspective view showing only a paper roll loading mechanism in the ink-jet printer shown in FIG. 1.
Figure 14:
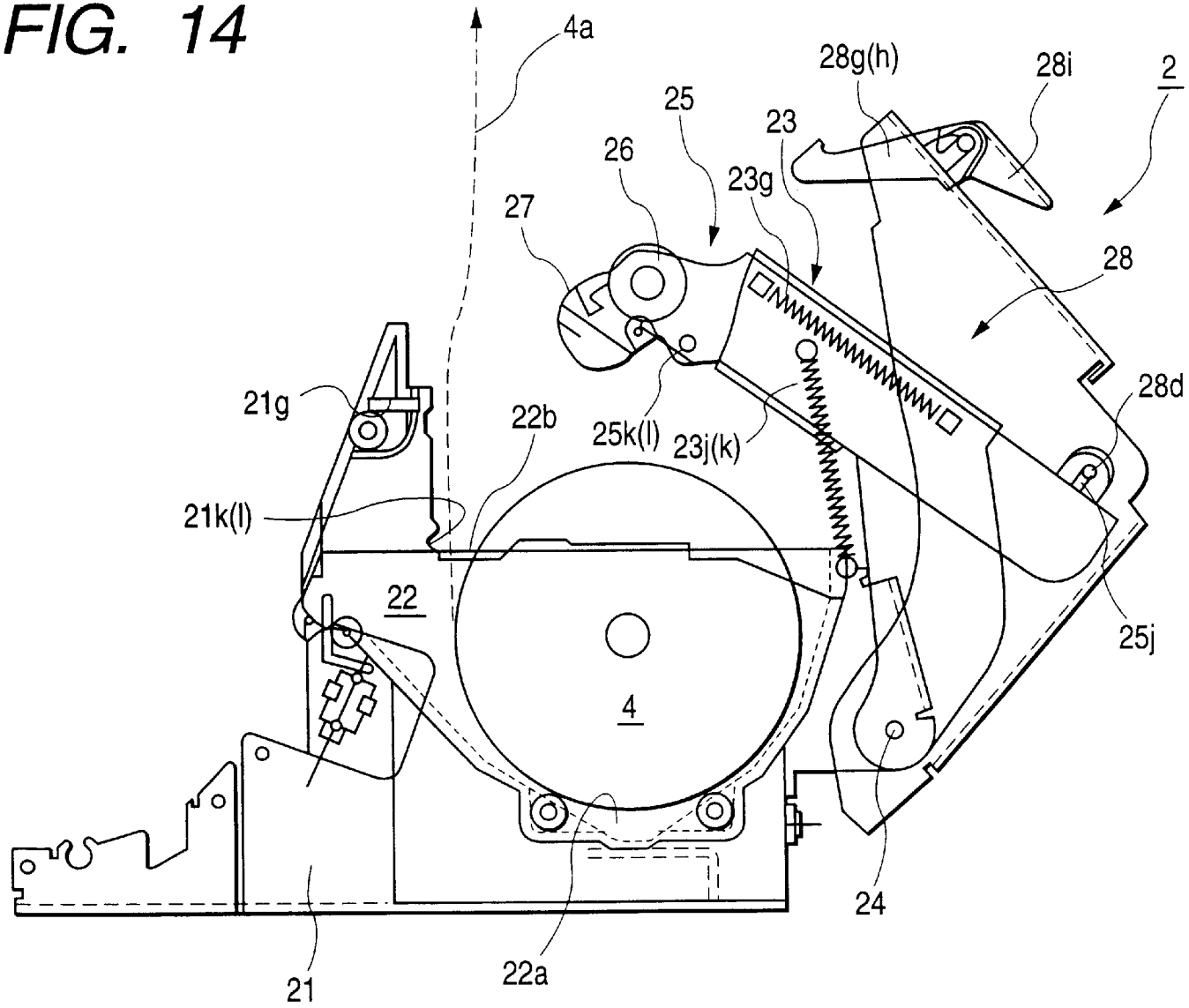
FIG. 14 is an explanatory drawing showing a state in which the cover frame of the paper roll loading mechanism shown in FIG. 11 is open with the cover frame approximately vertical.
Figure 15:
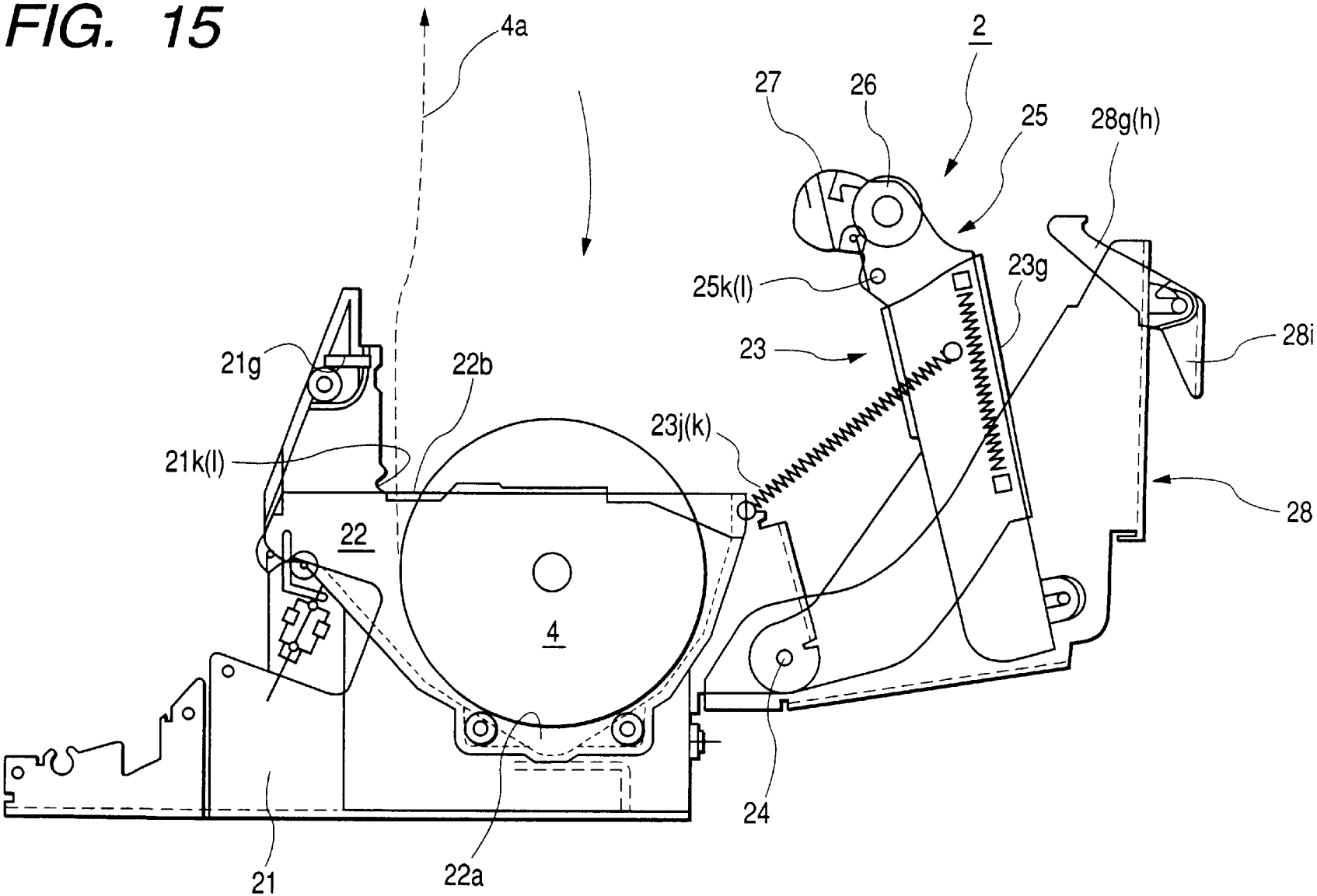
FIG. 15 is an explanatory drawing showing a state in which the paper roll loading part of the paper roll loading mechanism shown in FIG. 11 is completely open.
Figure 16A:
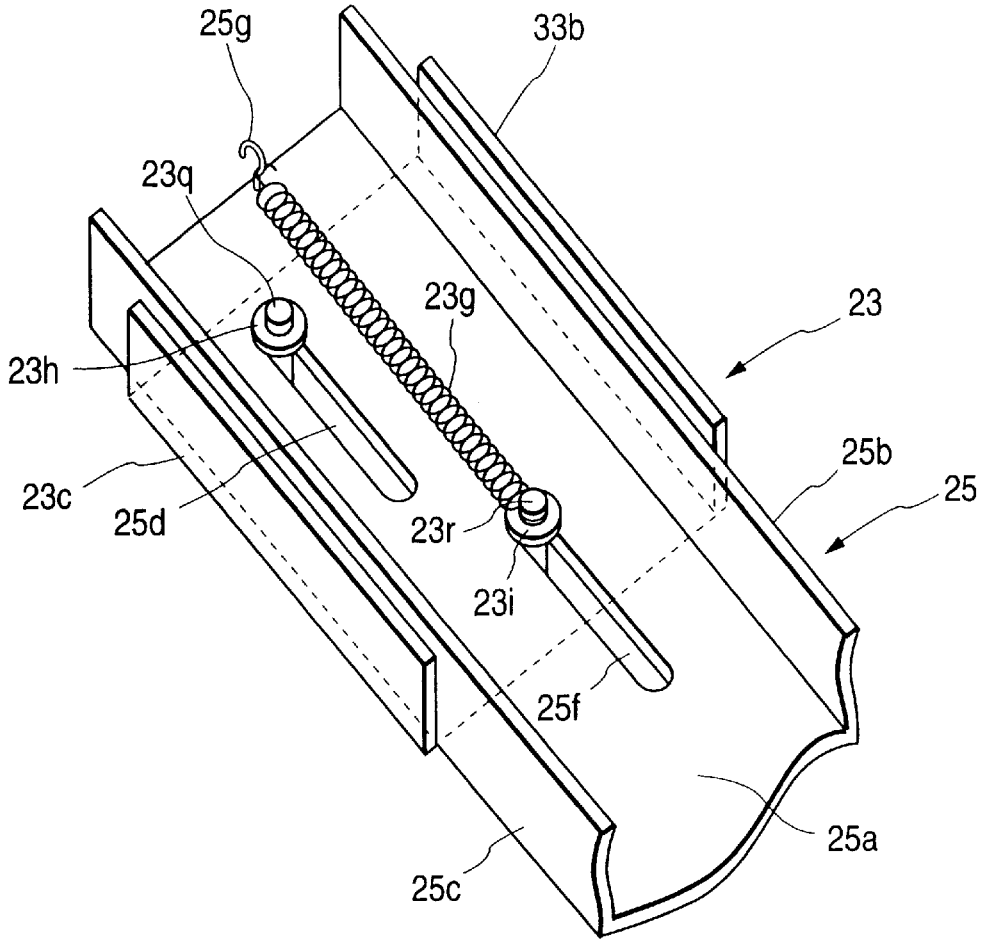
FIGS. 16 are explanatory drawings showing a state in which a slide frame is attached to the lid frame in the paper roll loading mechanism shown in FIG. 11.
Figure 16B:
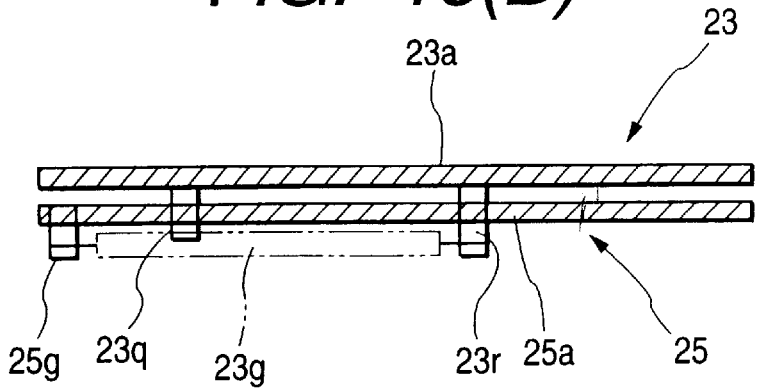

FIG. 11 is a perspective view showing only the paper roll loading mechanism 2, FIGS. 12 to 15 are explanatory drawings showing operation for opening/closing a paper roll loading part and FIGS. 16 are explanatory drawings showing its partial configuration.

As shown in these drawings, the paper roll loading mechanism 2 is provided with the frame for attachment 21 attached to the printer body frame 12 and the paper roll loading part 22 into which the paper roll 4 is loaded is formed inside the frame for attachment 21. The paper roll loading part 22 is provided with a semi-circular curved part 22*a* with predetermined width and a rectangular opening 22*b* formed over it and the paper roll 4 is replaced with a new one through the opening 22*b*.

The opening 22*b* for loading a paper roll can be opened or closed by a lid frame 23. The lid frame 23 is provided with a top plate 23*a* in approximately the same rectangular shape as the opening 22*b* and side plates 23*b* and 23*c* with predetermined height bent downward perpendicularly from the right and the left of the top plate 23*a*.

Each rear end of the side plates 23*b* and 23*c* is bent downward and each lower end 23*d* and 23*e* (only the lower end 23*d* is shown in the drawing) is supported by a shaft 24 defining the center of a turn so that the lid frame can be turned. Both ends of the shaft 24 are supported by the frame for attachment 21. Therefore, the lid frame 23 can be turned between a closed position shown in FIG. 12 in which the opening 22*b* for loading a paper roll of the paper roll loading part 22 is closed and an open position shown in FIG. 15 in which the opening 22*b* is completely open with the shaft 24 in the center.

The slide frame 25 is attached to the lid frame 23 provided as described above. The slide frame 25 is turned with it integrated with the lid frame 23, can be slid on the lid frame 23, and the platen roller 26 and the paper guide 27 for guiding the paper roll 4 to the platen roller 26 are attached to the end.

First, referring to FIG. 16, configuration such that the slide frame 25 is attached so that it can be slid on the lid frame 23 will be described. The slide frame 25 is provided with a rectangular top plate 25*a* touched to the back side of the top plate 23*a* of the lid frame 23 and side plates 25*b* and 25*c* with fixed height bent downward perpendicularly from both sides of the top plate 25*a*. Slits for guiding 25*d* and 25*f* are formed in the forward and backward direction of the top plate on the top plate 25*a* and guide pins 23*q* and 23*r* fixed to the surface plate 23*a* of the lid frame 23 respectively pierce these slits. Retaining rings 23*h* and 23*i* are respectively attached to the respective lower end sides of the guide pins 23*q* and 23*r* and hereby, the slide frame 25 is attached to the back surface of the lid frame 23 so that the slide frame can be slid.

A coil spring 23*g* is suspended between the guide pin 23*r* on the back side and a spring hook 25*g* formed on the front side of the slide frame 25 and the slide frame 25 is always pressed backward by the spring of the coil spring 23*q*.

Next, as clear from FIG. 11, the platen roller 26 lies between the front ends 25*h* and 25*i* of the respective side plates 25*b* and 25*c* of the slide frame 25, and both ends of a spindle of the platen roller 26 are supported by the front ends 25*h* and 25*i* so that the platen roller can be rotated. The paper guide 27 having the convex arc shaped from the outer peripheral surface of the platen roller 26 toward a direction of a tangent line is attached to the lower side of the platen roller 26.

Next, a cover frame 28 which is a size larger than the lid frame 23 is arranged on the upper side of the lid frame 23. The cover frame 28 is provided with a top plate 28*a* and side plates 28*b* and 28*c* bent downward perpendicularly from both sides of the top plate, each rear end of the side plates 28*b* and 28*c* is extended downward and is supported by the shaft 24 so that the cover frame can be turned.

Figure 13:
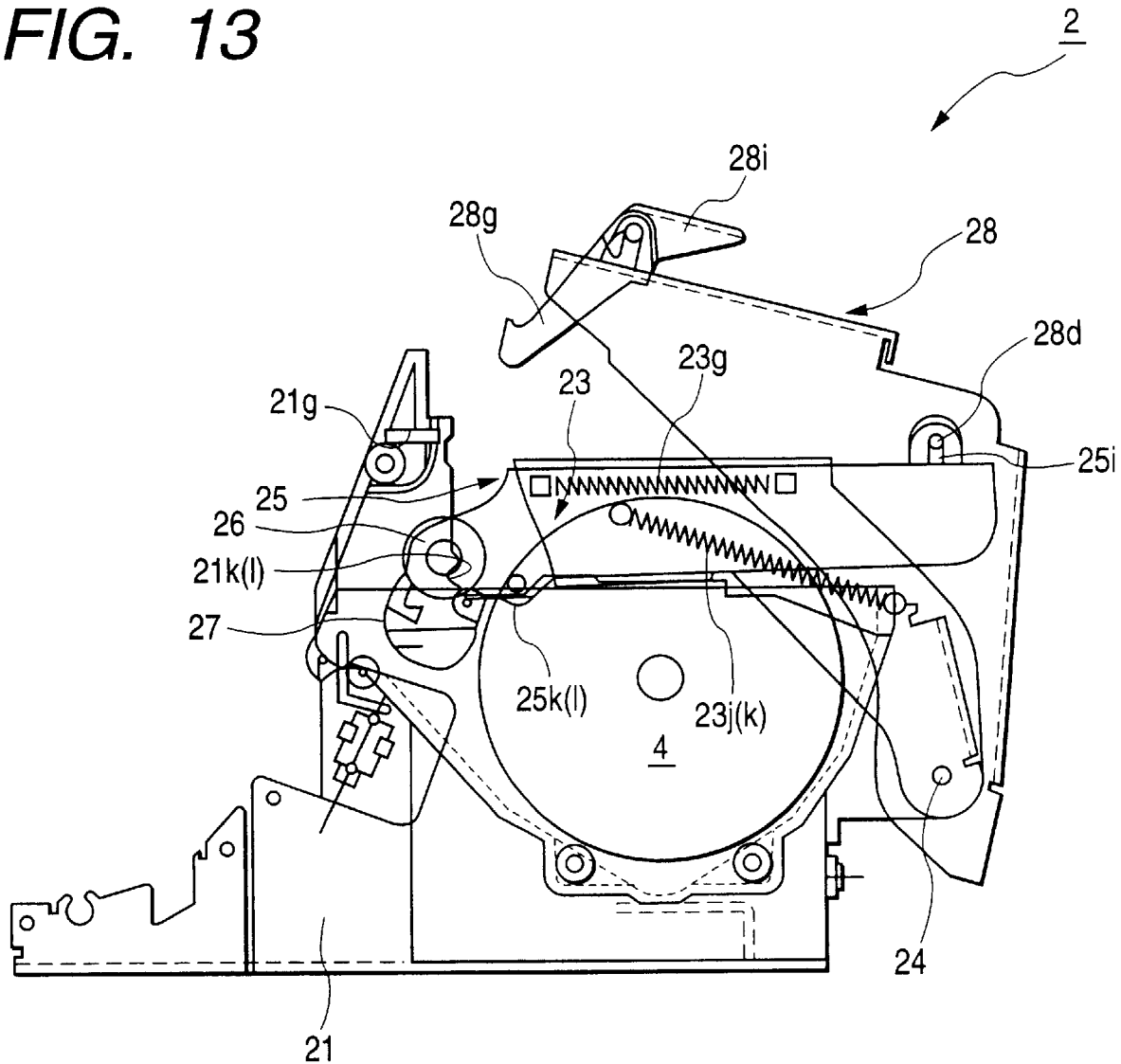
FIG. 13 is an explanatory drawing showing a state after the locking of a cover frame closing the paper roll loading part of the paper roll loading mechanism shown in FIG. 11 is released.

When the cover frame 28 is turned, the lid frame 23 to which the slide frame 25 is attached is turned together. When the lid frame 23 closes the opening 22*b* for loading a paper roll as shown in FIG. 13, the cover frame 28 can be independently turned. The slide frame 25 is slid forward and backward on the lid frame 23 by an independent turn of the cover frame 28.

A link mechanism 29 for transforming the independent turn of the cover frame 28 to a slide movement of the slide frame 25 is provided with a coupling shaft 28*d* laid between the respective upper ends on the back side of the side plates 28*b* and 28*c* of the cover frame 28 and coupling holes 25*j* through which the coupling shaft 28*d* passes are formed in three locations at the rear end of the slide frame 25. The coupling hole 25*j* is shaped in longitudinally elongated so that the hole does not prevent the independent turn of the cover frame 28. Therefore, as shown in FIG. 13, in a state that the lid frame 23 closes the opening 22*b* for loading a paper roll further turns the cover frame 28 and the cover frame is turned until the same lever of horizontal condition as shown in FIG. 12, the position of the coupling shaft 28*d* is moved forwardly and downwardly around the shaft 24 defining the rotation of the center.

The coupling shaft 28*d* is moved freely downward along the coupling hole 25*j* in vertically elongated and moves the coupling hole 25*j* by pressing it forward. As a result, the slide frame 25 where the coupling hole 25*j* is formed is pushed forward as a whole.

That is, the slide frame is slid forward on the lid frame 23, the platen roller 26 and the paper guide 27 respectively supported by the front end are protruded forward to the position 11 printed by the ink-jet head 8 and are opposite to the ink-jet head 8 with a fixed gap kept.

Figure 12:
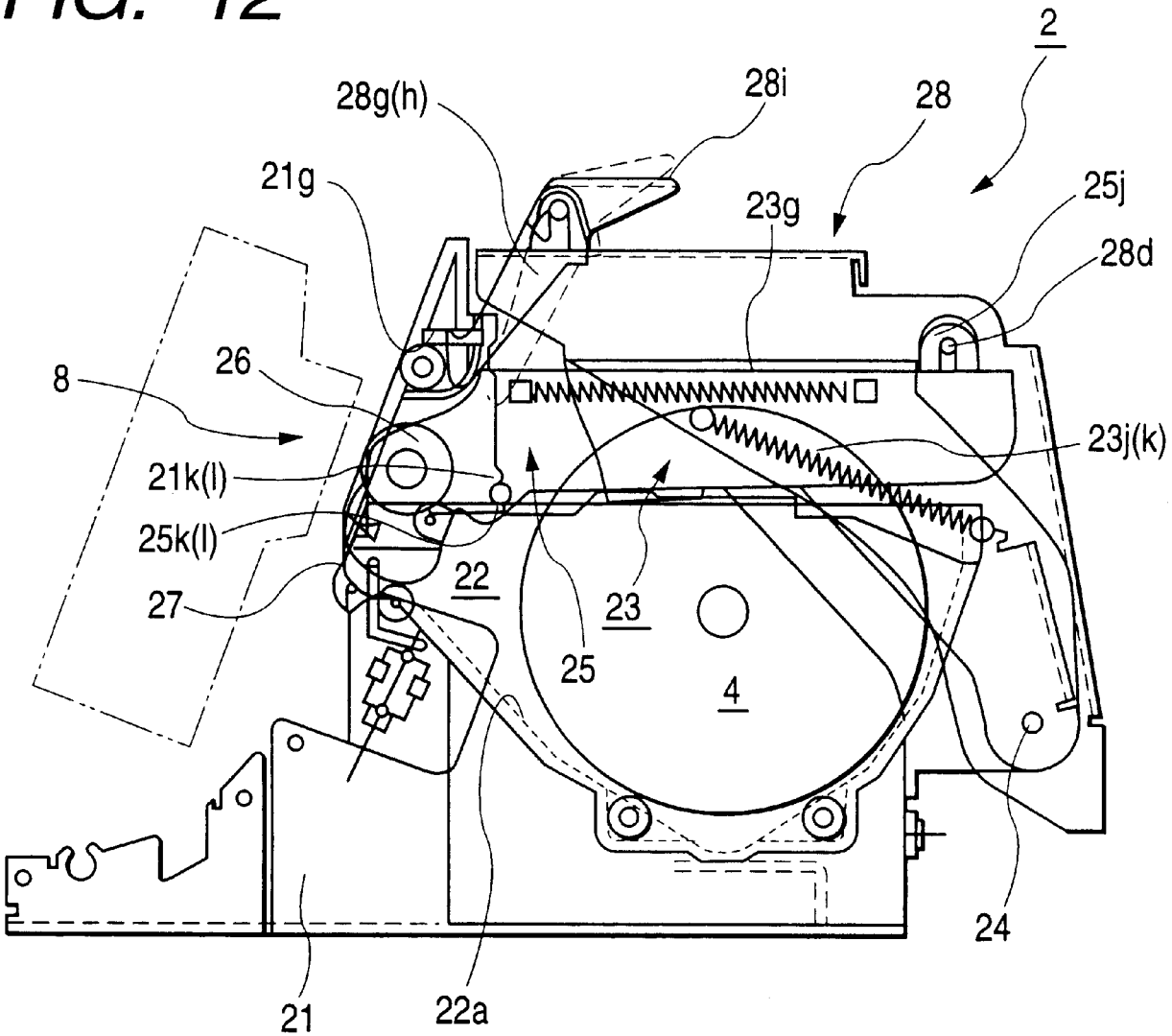
FIG. 12 is an explanatory drawing showing a state in which a paper roll loading part of the paper roll loading mechanism shown in FIG. 11 is closed.

Conversely, when the cover frame 28 is turned upward from a horizontal position shown in FIG. 12 to a position shown in FIG. 13, the slide frame 25 is slid backward as a whole to the contrary to the description, and the platen roller 26 and the paper guide 27 respectively at the end are moved to a back position backed from the opposite position.

As described above, the slide frame 25 is pressed backward by the elastic force generated by the coil spring 23*g*. Therefore, as shown in FIG. 12, when the pressure of the cover frame 28 is released after the cover frame 28 is closed until it is horizontal, the slide frame 25 is returned to the back position by the tensile force of the coil spring 23*g*. The cover frame 28 is also turned in a direction in which it is opened at the same time as the slide and is restored to a state shown in FIG. 13.

To lock the cover frame 28 in a closed position shown in FIG. 12, a pair of right and left fitting pawls 28*g* and 28*h* are attached to each front end of the cover frame 28. A fitted part 21*g* to which a hook can be fitted by turning it from the lower side is formed on the front side of the frame for attachment 21 to which the hook formed at each end of these fitting pawls 28*g* and 28*h* is opposite in a state in which the cover frame 28 is closed. The fitting pawls 28*g* and 28*h* are always pressed by a torsion spring not shown to a direction in which the hook is turned upward.

Therefore, when the cover frame is further pressed after the cover frame 28 is closed as shown in FIG. 12, the fitting pawls 28*g* and 28*h* are slightly turned on a reverse side against spring, the respective hooks at each lower end of the fitting pawls are fitted to each fitted part 21*g* on the side of the frame for attachment 21 from the lower side and a locked state is formed. To release the locked state, each upper end 28*i* of the fitting pawls 28*g* and 28*h* is pulled up and the hook at each lower end has only to be turned downward.

Next, in the paper roll loading mechanism 2 in this embodiment, a mechanism for precisely positioning the platen roller 26 at the end of the slide frame 25 in a state in which the cover frame 28 is closed is provided as described above. That is, positioning pins 25*k* and 25*l* (only the pin 25*k* is shown in FIG. 11) protruded horizontally right and left for defining a position are attached to each front end of the side plates 25*b* and 25*c* of the slide frame 25. In the meantime, semi-circular grooves 21*k* and 21*l* into which these positioning pins 25*k* and 25*l* are respectively fitted from a lateral direction are formed in each part opposite to these positioning pins 25*k* and 25*l* in a state in which the slide frame 25 is closed of the frame for attachment 21.

As these grooves 21*k* and 21*l* are respectively formed in a fixed position, the position of the platen roller 26 at the end of the slide frame 25 is always precisely defined by respectively fitting the positioning pins 25*k* and 25*l* of the slide frame 25 into these grooves 21*k* and 211. Therefore, the surface of an ink nozzle of the in-jet head 8, which is reciprocated in right and left, is maintained to the constant gap with respect to the surface of the platen roller 16 as same as the predetermined gap with respect to the platen for cut paper 13.

A coil spring 23*j* or 23*k* (only 23*j* is shown in the drawing) is respectively bridged between both side walls 21*b* and 21*c* (only 21*b* is shown in FIG. 11) of the frame for attachment 21 and side plates 23*b* and 23*c* on both sides of the lid frame 23. If the cover frame 28, the slide frame 25 and the lid frame 23 are opened or closed with the shaft 24 in the center, these coil springs 23*j* and 23*k* are arranged so that a locus of a turn of a part for suspending each spring at both ends of each coil spring 23*j* or 23*k* is extended after the position of the center of gravity of these frames passes the position of the turn shown in FIG. 14 over the shaft 24.

Therefore, as these coil springs 23*j* and 23*k* are extended if the cover frame 28 is further opened across the position of the turn shown in FIG. 14, tensile force pressing in a direction in which the cover frame 28 is closed acts. As a result, it is free from a problem that the cover frame 28 and others are sharply opened and collide with the other part.

Conversely, if the cover frame 28 is closed across the position of the turn shown in FIG. 14, it is free from a problem that the cover frame 28 is sharply closed and collide with the opening 22*b* of the paper roll loading part by the spring of these coil springs 23*j* and 23*k*.

Operation of Paper Roll Loading Mechanism

Referring to FIGS. 12 to 15, operation for opening or closing the paper roll loading part 22 in the paper roll loading mechanism 2 will be collectively described below. First, when the part at the upper end 28*i* coupled to the fitting pawl 28*g* or 28*h* is pulled upward in a state in which the paper roll loading part 22 is closed as shown in FIG. 12, the fitting pawl 28*g* or 28*h* goes off the fitted part 21*g* on the side of the frame 21 and locking is released. As a result, the cover frame 28, the slide frame 25 and the lid frame 23 are turned to the respective positions shown in FIG. 13 together and are opened. The turning operation is enabled by the spring of the coil spring 23*g* spanned between the slide frame 25 and the lid frame 23.

Afterward, when the cover frame 28 is turned backward against the spring of the coil springs 23*j* and 23*k*, the opening 22*b* of the paper roll loading part 22 is completely opened as shown in FIG. 15 through a state shown in FIG. 14. That is, none of the cover frame 28, the slide frame 25 and the lid frame 23 exists over the opening 22*b*.

After the frames are completely opened, the paper roll 4 loaded into the paper roll loading part 22 is replaced with a new one. As the opening 22*b* is completely open, work for replacing paper rolls is simple. As the platen roller 26 and the paper guide 27 are also backed together with the slide frame 25, work for arranging an unwound part 4*a* of a new paper roll 4 is also simple.

After the paper roll 4 is loaded, the cover frame 28 is turned in a direction in which it is closed. By the operation, the cover frame 28, the slide frame 25 and the lid frame 23 are turned together and the lid frame 23 closes the opening 22*b* as shown in FIG. 13 through the state shown in FIG. 14. Afterward, the lid frame 23 is fitted to the edge of the opening 22*b* and is not turned any more. Therefore, the slide frame 25 attached to the lid frame 23 so that the slide frame can be slid is also not turned any more. Therefore, afterward, only the cover frame 28 is independently turned. When the cover frame 28 is pressed and is turned to a position shown in FIG. 12, the turning motion is transformed to a slide motion of the slide frame 25 through the link mechanism 29. That is, the slide frame 25 is slid forward on the lid frame 23, and the platen roller 26 and the paper guide 27 respectively supported at the front end reach the respective positions opposite to the ink-jet head 8 with a fixed gap kept. When the slide frame 25 is slid forward, the positioning pins 25*k* and 25*l* at both ends of the slide frame 25 are respectively fitted into the grooves 21*k* and 21*l* on the side of the frame for attachment 21 and respective slid positions are fixed. In other words, the platen roller 26 and the paper guide 27 are respectively kept in preset opposite positions and a fixed gap is formed between the ink-jet head 8 and one of them.

In this state, the platen roller driving gear 31 coupled to one end of the platen roller 26 is engaged with the gear 73 shown in FIG. 10 arranged on the side of the frame for attachment 21.

Therefore, when the gear 73 is driven and rotated, the platen roller 26 is rotated, the unwound part 4*a* of the paper roll 4 is carried in a transport direction (in a direction shown by an arrow) and the ink-jet head 8 executes predetermined printing operation in synchronization with the feeding operation.

Other Embodiments

In the embodiment, the paper roll loading part 22 in the paper roll loading mechanism 2 is opened or closed and in addition, the platen roller 26 is supported by the slide mechanism. Therefore, to precisely define a relative position between the platen roller 26 and the platen member for cut paper 14, the frame for attachment 21 is provided with the positioning mechanisms for the platen roller 26 and platen member for cut paper 14. However, structure that the platen roller 26 is arranged in a fixed position can be also adopted and in this case, a positioning part for defining the position of a platen member for cut paper has only to be arranged on the side of a member supporting a platen roller 26.

A word of printing in this specification has the same meaning as recording and includes not only the printing of a character but the printing of a pattern, a symbol and others.

Industrial Availability

As described above, the printer according to the present invention is suitable for an ink-jet printer for printing both a paper roll and cut paper. For example, the printer is suitable for a printer for a POS terminal wherein a paper roll is used for issuing a receipt and cut paper is used for issuing a cutform and others.

What is claimed is:

1. A printer in which a printing position for roll paper is formed in a part of a printing position for cut paper, comprising:

a platen for roll paper defining a printing position for said roll paper;

a platen for cut paper defining a printing position for said cut paper; and a print head for printing said roll paper and said cut paper in a common printing position, wherein the surface defining a printing position of said platen for roll paper is disposed rearwardly at least by the thickness of said roll paper from the surface defining a printing position of said platen for cut paper.

2. A printer according to claim 1, wherein the platen for cut paper is shaped in a rectangular plate having a opening, and said platen for the roll paper is provided at the inside of the opening.

3. A printer according to claim 2, wherein said platen for roll paper is move able toward and away from the opening of the platen for cut paper.

4. A printer according to claim 3 filter comprising:

a frame for positioning said platen for cut paper and supporting said platen for cut paper, wherein said platen for roll paper has a positioning member, wherein said frame has a contact part, said positioning member contacting with said contact part when said platen for roll paper moves close to the side of said opening, and wherein a position of said platen for roll paper relative to said platen for cut paper is defined by contacting said positioning member to said contact part.

5. A printer according to any of claims 1 to 4, further comprising:

a paper feeding roller for feeding said roll paper through said printing position for roll paper; and tension applying means for applying tension to a printing face of said roll paper fed through said printing position in a transport direction.

6. A printer according to claim 5, wherein said platen for roll paper has a paper guide for guiding said roll paper to said printing position, and said tension applying means includes a pressing member for pressing said roll paper upon said paper guide by predetermined elastic force.

7. A printer according to claim 6, wherein said pressing member is a pressing roller which is freely rotated, and the peripheral surface of said pressing roller is pressed upon said paper guide through said roll paper.

8. A printer according to claim 5, wherein said tension applying means includes a brake roller arranged in a position pressed by said pressing member of said paper guide, and said brake roller has a roller body freely rotationally supported and a pressure spring applying predetermined elastic force to the side surface of the roller body.

9. A printer according to claim 5, further comprising:

a driving motor for rotating said roll paper feeding roller;

a gear train for transmitting the rotation of said driving motor to said roll paper feeding roller; and a rotation restriction means for applying braking force for restricting free rotation of a gear included in said gear train for feeding said roll paper.

10. A printer according to claim 9, further comprising:

a cut paper feeding roller;

a gear train for feeding cut paper for transmitting the rotation of said driving motor to said cut paper feeding roller; and switching means for switching the transmission of the rotation of said driving motor to one of said gear train for feeding roll paper and said gear train for feeding cut paper.

11. A printer according to claim 9, wherein said gear train for feeding roll paper includes a gear rotated together with said roll paper feeding roller; and braking force is applied to a gear directly engaged with said gear rotated together with said roll paper feeding roller by said rotation restriction means.

12. A printer according to claim 5, further comprising:

a driving motor for rotating said roll paper feeding roller;

a gear train for transmitting the rotation of said driving motor to said roll paper feeding roller; and rotation preventing means for preventing a gear included in said gear train for feeding roll paper from being rotated, wherein the rotation of said gear is prevented by said gear rotation preventing means while said driving motor is stopped.

13. A printer according to claim 12, further comprising:

a cut paper feeding roller;

a gear train for transmitting the rotation of said driving motor to said cut paper feeding roller; and switching means for switching the transmission of the rotation of said driving motor to one of said gear train for feeding roll paper and said gear train for feeding cut paper, wherein said rotation preventing means prevents the rotation of said gear while the rotation of said driving motor is transmitted to said gear train for feeding cut paper.

14. A printer according to claim 12, wherein said gear train for feeding roll paper includes a gear rotated together with said roll paper feeding roller, and the rotation of a gear engaged with said gear rotated together with said roll paper feeding roller is prevented by said rotation preventing means.

15. A printer according to claim 10, further comprising a paper guide for guiding roll paper to said printing position; and a pressing roller for pressing roll paper upon said paper guide by predetermined elastic force.

16. A printer according to claim 13, further comprising:

a paper guide for guiding roll paper to said printing position; and a pressing roller for pressing roll paper upon said paper guide by predetermined elastic force.

17. A printer according to claim 13, wherein said gear train for feeding roll paper includes a gear rotated together with said roll paper feeding roller; and braking force is applied to a gear directly engaged with said gear by said rotation restriction means.

18. A printer according to claim 10, wherein the platen for cut paper is shaped in a rectangular plate having a opening, said platen for the roll paper is provided at the inside of the opening and said platen for roll paper is approached and is separated from the opening of the platen for cut paper, further comprising:

a frame for positioning said platen for cut paper and supporting said platen for cut paper, wherein said platen for roll paper has a positioning part, and said frame has a contact part with which the part for positioning said platen for roll paper comes in contact when said platen for roll paper approaches the side of said opening, and wherein positional relationship between said platen for roll paper and said platen for cut paper is defined by contacting said positioning part to said contact part.

19. A printer according to claim 13, wherein the platen for cut paper is shaped in a rectangular plate having a opening, said platen for the roll paper is provided at the inside of the opening and said platen for roll paper is approached and is separated from the opening of the platen for cut paper, further comprising:

a frame for positioning said platen for cut paper and supporting said platen for cut paper, wherein said platen for roll paper has a positioning part, and said frame has a contact part with which the part for positioning said platen for roll paper comes in contact when said platen for roll paper approaches the side of said opening, and wherein positional relationship between said platen for roll paper and said platen for cut paper is defined by contacting said positioning part to said contact part.

* * * * *